US008905403B2

(12) United States Patent
Loewenstein et al.

(10) Patent No.: US 8,905,403 B2
(45) Date of Patent: Dec. 9, 2014

(54) CARDS AND CARD GAMES

(76) Inventors: David Loewenstein, Rye Brook, NY (US); Martin Joel Wolff, New York, NY (US)

( * ) Notice: Subject to any disclaimer, the term of this patent is extended or adjusted under 35 U.S.C. 154(b) by 911 days.

(21) Appl. No.: 11/431,066

(22) Filed: May 9, 2006

(65) Prior Publication Data

US 2006/0208423 A1 Sep. 21, 2006

Related U.S. Application Data

(63) Continuation of application No. 10/418,829, filed on Apr. 21, 2003, now Pat. No. 7,341,254, which is a continuation-in-part of application No. 10/081,095, filed on Feb. 22, 2002, now abandoned, and a continuation-in-part of application No. 10/015,314, filed on Dec. 11, 2001, now abandoned, and a continuation-in-part of application No. 10/211,063, filed on Aug. 2, 2002, now abandoned.

(60) Provisional application No. 60/429,241, filed on Nov. 27, 2002.

(51) Int. Cl.

| | |
|---|---|
| ***A63F 1/00*** | (2006.01) |
| ***G07F 17/32*** | (2006.01) |
| ***A63F 1/02*** | (2006.01) |
| *A63F 1/04* | (2006.01) |
| *A63F 9/20* | (2006.01) |

(52) U.S. Cl.

CPC ..... *G07F 17/32* (2013.01); *A63F 2001/0491* (2013.01); *A63F 2001/005* (2013.01); *G07F 17/3293* (2013.01); *A63F 2001/008* (2013.01); *A63F 1/02* (2013.01); *A63F 1/00* (2013.01); *A63F 9/20* (2013.01)

USPC ..... 273/292

(58) Field of Classification Search

USPC ..... 273/292

See application file for complete search history.

(56) References Cited

U.S. PATENT DOCUMENTS

| | | | | | |
|---|---|---|---|---|---|
| 1,194,858 | A | * | 8/1916 | Mathews | 273/294 |
| 2,776,498 | A | * | 1/1957 | MacDonald et al. | 434/129 |
| 3,428,323 | A | * | 2/1969 | Fried | 273/296 |
| 4,119,322 | A | * | 10/1978 | Weigl | 273/293 |
| 4,428,582 | A | * | 1/1984 | Smith | 273/296 |
| 4,693,480 | A | * | 9/1987 | Smith | 273/296 |
| 4,702,479 | A | * | 10/1987 | Banasiak et al. | 273/148 R |
| D301,592 | S | * | 6/1989 | Needler | D21/378 |
| 5,282,633 | A | * | 2/1994 | Boylan et al. | 273/306 |
| 5,887,873 | A | * | 3/1999 | Freeman | 273/303 |
| 5,895,048 | A | * | 4/1999 | Smith, Jr. | 273/293 |
| 6,007,066 | A | * | 12/1999 | Moody | 273/292 |
| 6,050,569 | A | * | 4/2000 | Taylor | 273/292 |
| 6,145,839 | A | * | 11/2000 | Katsion et al. | 273/308 |
| 6,149,155 | A | * | 11/2000 | Hoyt et al. | 273/292 |
| 6,447,300 | B1 | * | 9/2002 | Greenberg | 434/188 |
| 6,899,619 | B2 | * | 5/2005 | Efremov | 463/11 |
| 6,964,418 | B2 | * | 11/2005 | Moody | 273/292 |
| 2005/0037834 | A1 | * | 2/2005 | Stern et al. | 463/20 |
| 2008/0119257 | A1 | * | 5/2008 | Stern et al. | 463/13 |

* cited by examiner

*Primary Examiner* — Kurt Fernstrom
*Assistant Examiner* — Dolores Collins

(57) ABSTRACT

A method and apparatus to play poker or blackjack games that include novel playing cards that do not have non-descriptive backs and novel card arrangements with multiple hands sharing a common card. The novel cards have a first view showing either the suit or rank of the cards but not both, and a second view showing both the suit and the rank of the cards.

15 Claims, 9 Drawing Sheets

Two-Sided Draw Poker

CARDS AND CARD GAMES

This is a continuation of Ser. No. 10/418,829 first filed on Apr. 21, 2003 now U.S. Pat. No. 7,341,254 which claims priority from 60/429,241 first filed on Nov. 27, 2002; and a continuation in part of the following: Ser. No. 10/081,095 first filed on Feb. 22, 2002 now abandoned: Ser. No. 10/015,314 first filed on Dec. 11, 2001 now abandoned; and Ser. No. 10/211,063 first filed on Aug. 2, 2002 now abandoned. These applications are for a novel type of playing cards and various poker and blackjack games and are incorporated herein by reference in their entirety.

One novel aspect of theses inventions is that the cards have the numerical value (also called the rank) or the suit on one side and the both the suit and value on the other side. The result is that the cards have no non-descriptive backs, as conventional cards have.

Various poker-type or blackjack type games can be played using this card deck. For example, when a game is played the player typically will be presented with cards that have the suit or the rank, and the player will have to select which card will help him to achieve the best card hand for a particular game.

BACKGROUND

There are a few games that have unconventional cards. One game is called SPLIT and uses cards cut in half so that the top half of the card is one value and the bottom half has another value. Another game that seems to have cards without the suit is described in US 2001/0035608 A1.

These cards and games, however, are completely different from the cards and games described here.

DETAILED DESCRIPTION OF THE FIGURES

Figure 1:
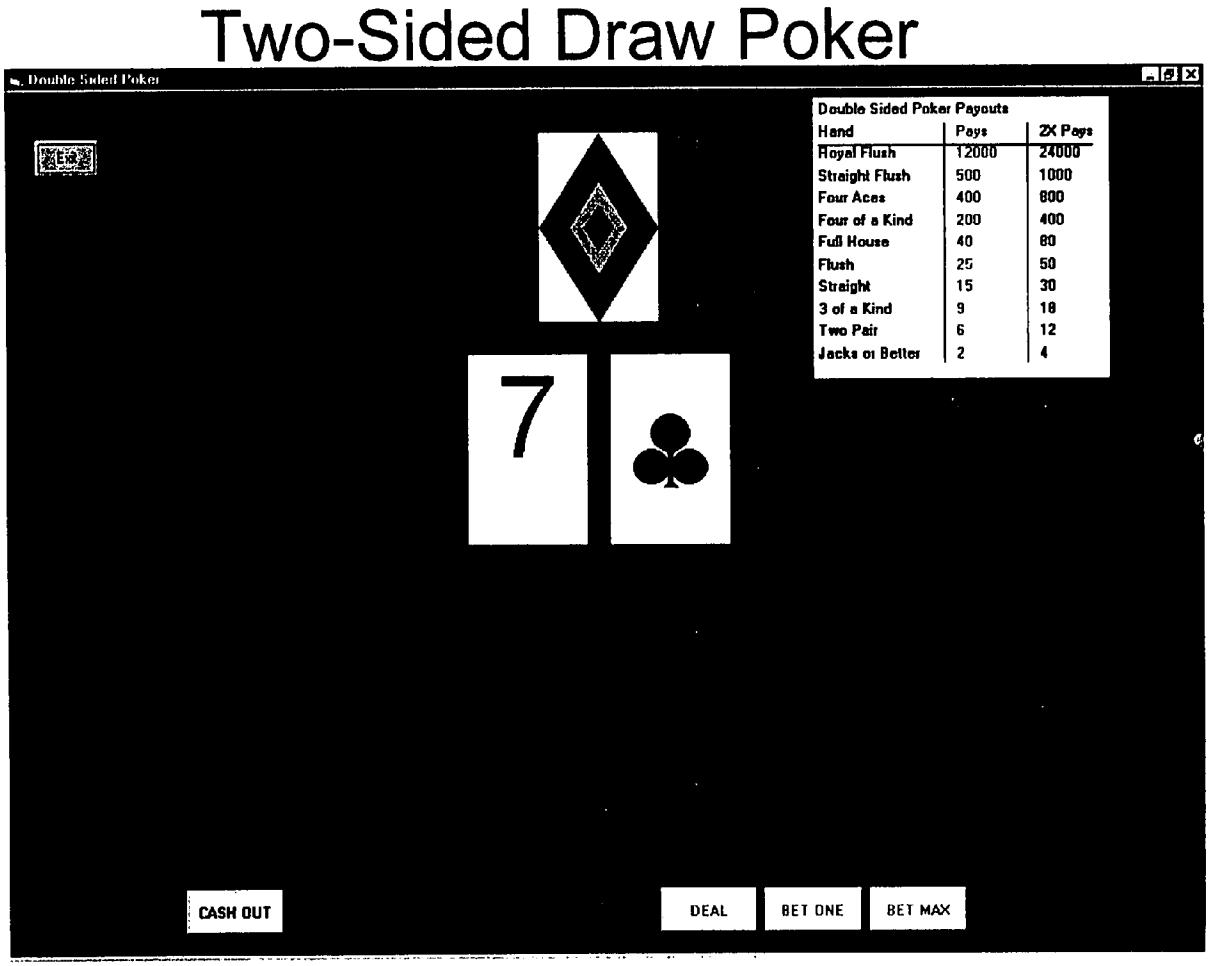
FIG. 1 shows a poker-type game where the player is presented with two cards, one which shows the rank and the other the suit, and the player is required to pick one to form a poker hand.

FIG. 1 shows a poker-type game using the novel cards of the disclosed invention. In this game, two cards 1-10 and 1-20 are dealt. One card, card 1-10, shows the rank (8) and the other card, card 1-20, shows the suit (club). The player is required to pick one of the cards to begin forming a five card poker hand. After he selects the card, it appears in the spaces designated by elements 1-30 to 1-70 with both the card rank and suit visible. For example, if the player picked card 1-20, it would reappear in space 1-30 and a new card would appear where card 1-20 had been. The player would then be given a choice between the new card and card 1-10, which would still be shown as a seven. After he made his choice the card would appear in space 1-40 and a new card would be shown in the space from where the card had been taken.

Figure 2:
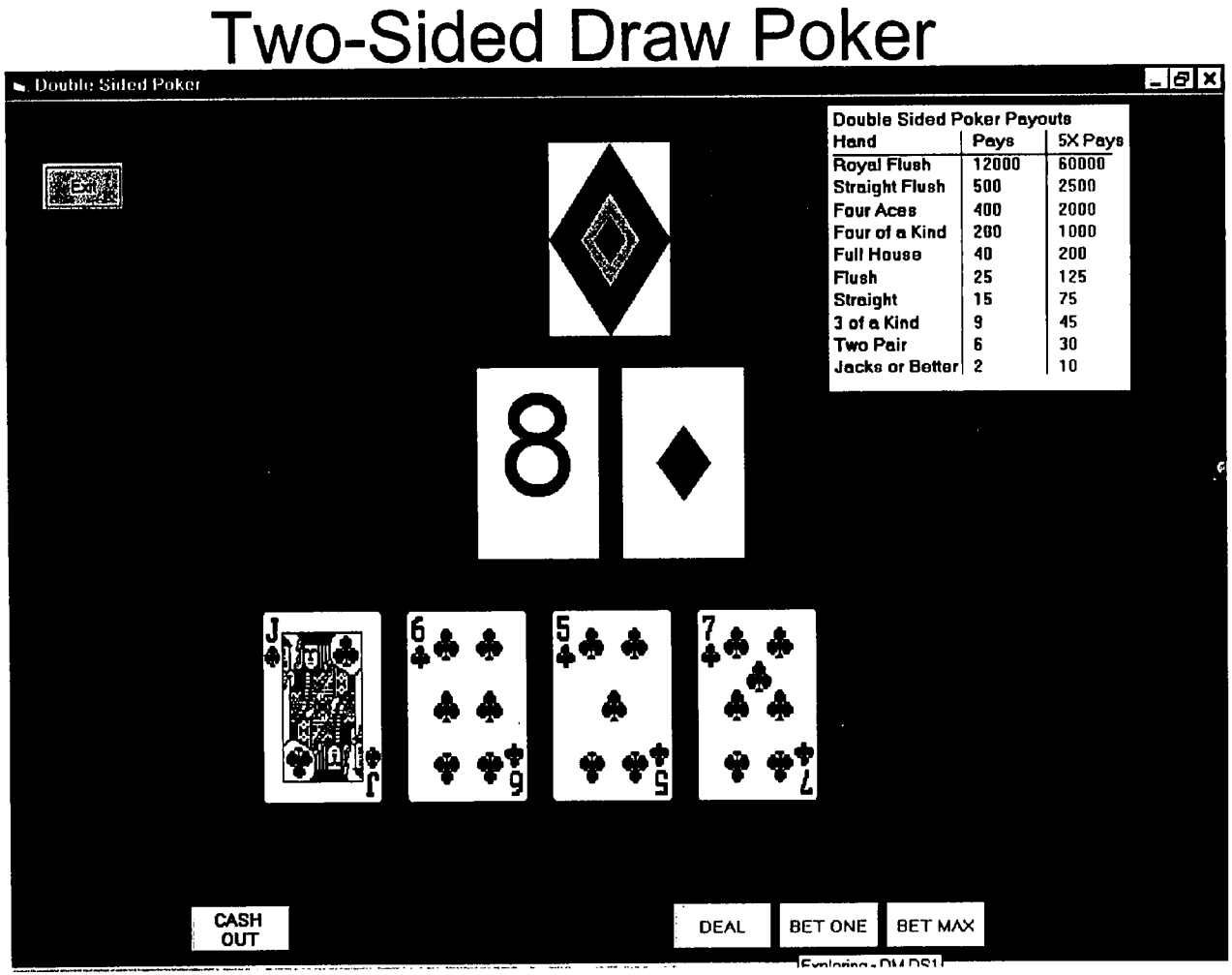
FIGS. 2 to 4 show another poker-type game where ten cards are dealt and the player is required to form a five-card hand.

FIG. 2 shows the game after four cards have been selected. The game would continue until all the spaces 1-30 through 1-70 were filled in. The hand would then be compared to a paytable 1-80 or to another hand, such as a dealer's hand for example.

The game could, of course be played with hands that consist of more or less cards than the five-card hand shown. For example, three or seven-card hands could be used.

Figure 3:
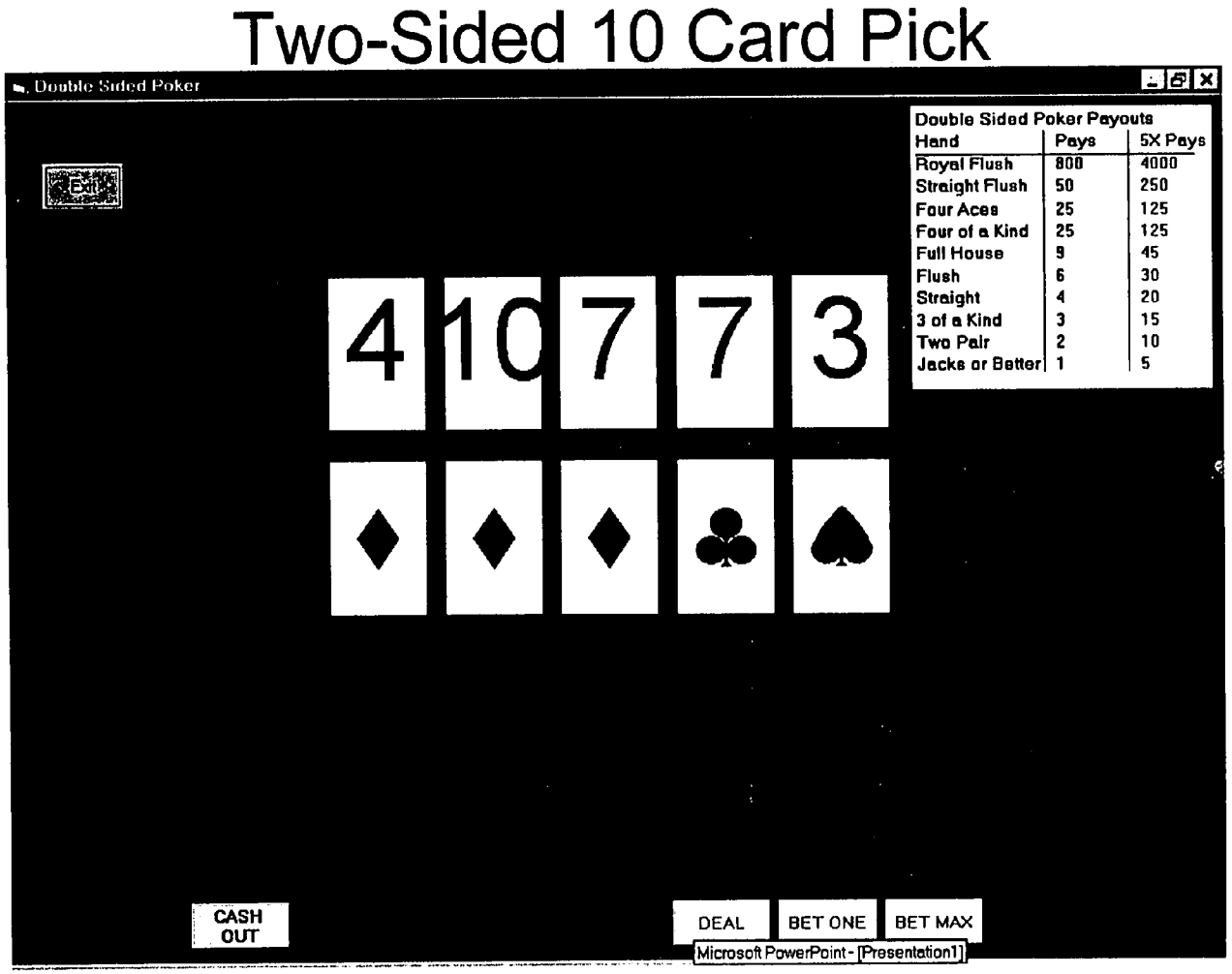
Figure 4:
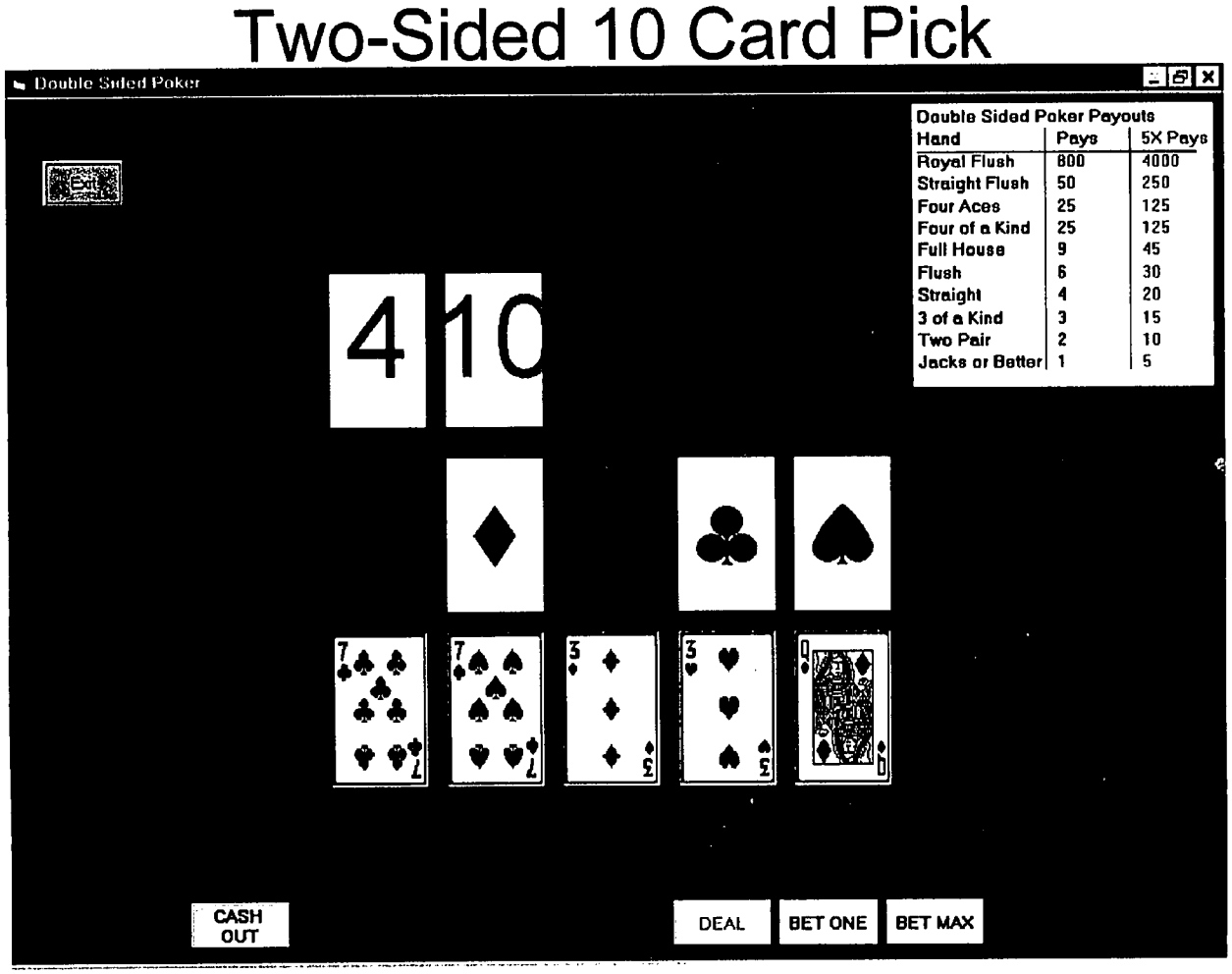

FIGS. 3 and 4 show a game where ten cards are initially dealt in two five-card rows.

One row displays only the rank of the cards, and the other row shows only the suit. For example, in FIG. 3 cards 3-200 to 3-240 only display the rank of the cards, and cards 3-250 to 3-290 show only the suit. The player then selects a five card poker hand from those cards. In this embodiment, when the player selects the cards they appear sequentially in spaces 2-300 to 2-340, as shown in FIG. 4, with both the rank and suit revealed. After the player has selected the five cards for his hand, the hand is compared to a paytable or to another hand (a dealer's for example), and the player is paid off accordingly.

FIG. 4 shows the game after five cards have been selected.

In another embodiment, both the rank and suit of the selected cards in spaces 2-300 and 2-340 are not revealed until after all five cards are selected.

This game could also be played in a three or seven hand version, where, for example the player would be required to select cards for a three or seven-card poker hand from the cards displayed. The number of initially dealt cards that are displayed cards could also be changed. For example, in a three-card version of the game, only five cards could be displayed. In the seven cards embodiment, 12 or 14 cards could be displayed, and the player could select from those cards. Of course, a seven-card game could be played using the ten-card display shown in FIG. 3. Also, the displayed cards need not be shown in rows. Columns, or some other configuration would serve the same purpose.

This game could also be played using eight and nine card versions. In the eight card version, for example, four rank cards and four suit cards would be displayed and the player would select a five card hand from those eight cards. In the nine card version, four rank cards and five suit cards could be displayed, or five rank and four suit cards could be displayed. Again, the player would be required to build a five card hand.

Based on computer modeling of the ten card game, it appears that forty percent of the time a player would get two pairs, which might make the game uneconomical to a casino. However, this occurs where the player follows an optimal strategy.

Blackjack

Figure 5:
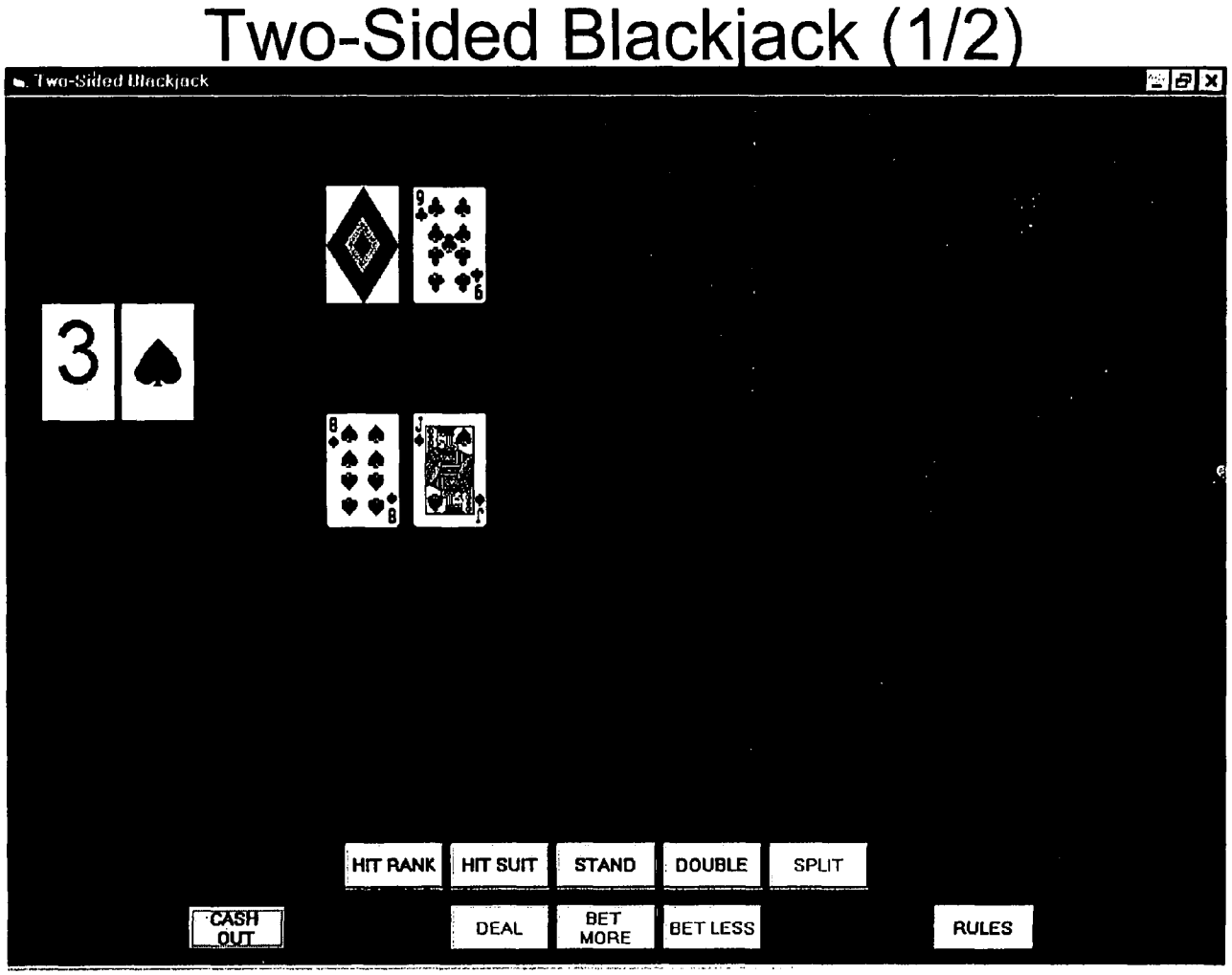
FIGS. 5 to 6 show a blackjack-type game.
Figure 6:
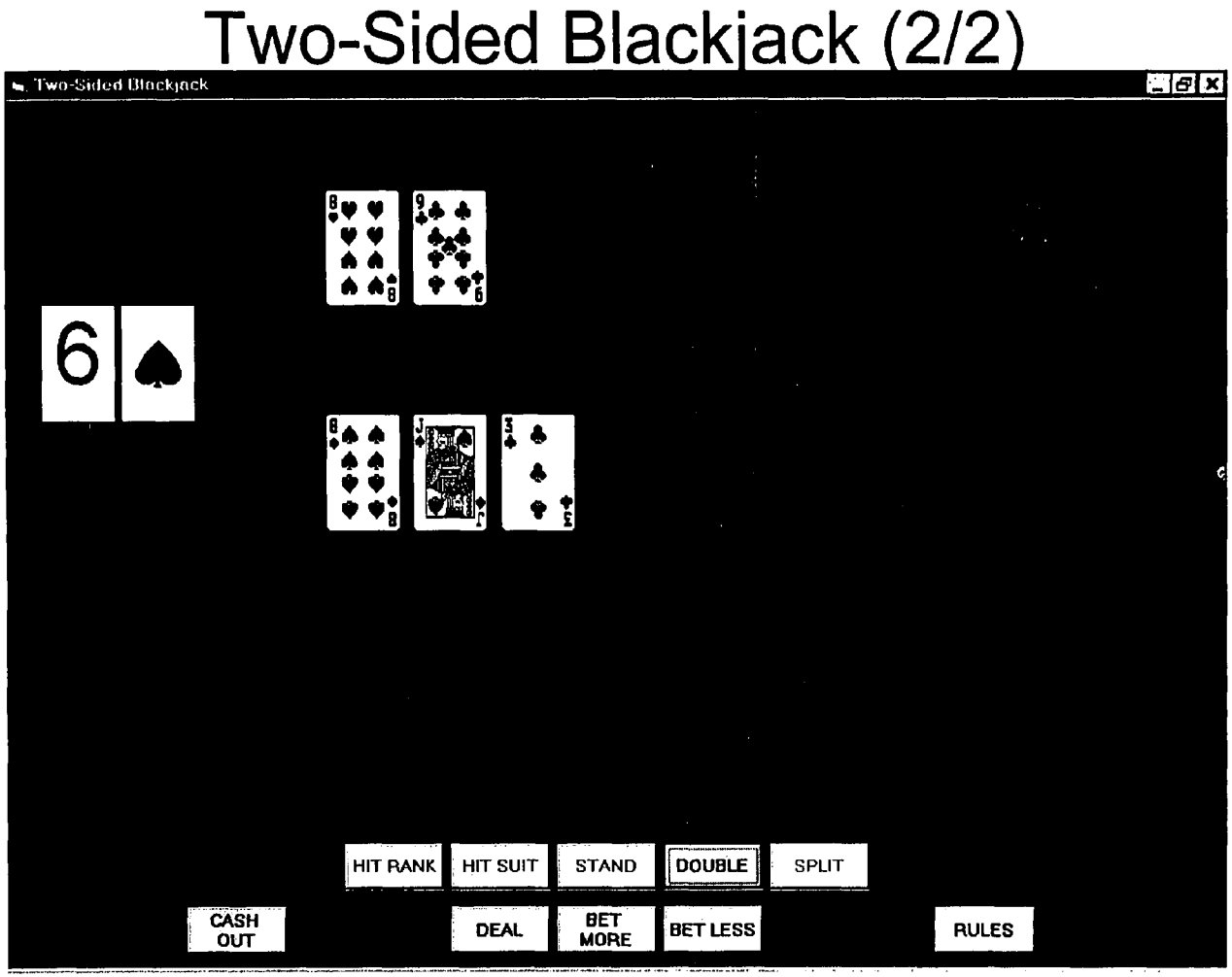

FIGS. 5 and 6 shows a blackjack game using the inventions described here.

In this game, the rules are similar to that of standard blackjack. Initially, the dealer is dealt cards 5-400 and 5-410 (although the precise order in which the cards are initially displayed is not important). Card 5-400 is shown as a conventional face down card, but it could also be a novel card described in this patent and display only the card's suit. The player is dealt cards 5-420 and 5-430, both face up with both the suit and rank showing. The player is then shown two cards 5-440 and 5-450. The player can see the rank of card 5-440 and the suit of card 5-450.

Based on this information, the player can select which card to draw, i.e., hit, or choose to take no more cards at all, i.e., stand. If he draws card 5-440, that card is added to his hand and another card that displays only the rank is displayed where card 5-440 had been, as shown in FIG. 6 element 6-440. His hand is then evaluated by the standard rules of blackjack to see if the total count or sum of the ranks of all of his cards is more than 21. If it is greater than 21, the player loses. If it is less than 21, the player is then given another opportunity to hit or stand. If he stands, play continues with the next player's hand, if the player has split his hand. If he has not split, the dealer's turn begins.

After card selection for the player's last hand is completed, the dealer's down card is revealed and the play continues as the dealer draws cards for his hand. The dealer's strategy could be the same as in ordinary blackjack. For example, the dealer must hit until 16 and stand over 16. The dealer's strategy could also be different and he would always draw card 6-440 provided it did not put him over 21.

As in ordinary blackjack, after the dealer has drawn his last card, and the dealer's total is less than 22, the player's hand, or hands, are compared individually with the dealer's hand. If the player's hand is closer to 21 than the dealer's, the player wins and vice versa. If both hands have the same value, there is a tie or push.

In one embodiment, the dealer draws cards from with the same two novel cards and to use the same strategy as the player. In this embodiment, the dealer can choose between the two cards displayed, and can select either the card displaying the rank or the card displaying the suit based on which is most likely to improve his hand. We have found the following set of rules for the dealer provides an entertaining embodiment of the game. The dealer will take rank cards 6-440 until his total is as close to 21 without exceeding it. He does not have to draw a rank card if it makes his card total greater than 21. If his card total is less than 17 and the next card 6-440 would make his total greater than 21, he can draw a suit card 6-450.

Another embodiment allows the dealer to hit if his hand is less than 21 and less than the player's. For example, if the player had 18, the dealer had 17 and the rank card displayed was 7, the dealer would take the suit card. This is because the dealer would lose if he stood (did not take a card), and would lose if he took the rank card (that would make him bust). Having nothing to lose by taking the suit card, the dealer would take the suit card and hope it was less than 4.

Other embodiments may utilize different rules to guide the dealer's drawing of cards as well. This game can be played on a video gaming machine such as those used in casinos today for standard draw poker or similar machines.

In the initial hands, the rules could be the same as in standard blackjack with respect to evaluating hands for 21; splitting hands; doubling down, insurance; and surrendering. In other embodiments, these rules may be modified to adjust the relative advantage of the dealer versus the player or players.

Card selection in any of these games could be with mechanical buttons or by using a touch screen. Voice or eye commands could also be used.

There are other games that can be played with the novel cards described in this application and co-pending application Ser. No. 10/081,095.

Figure 7:
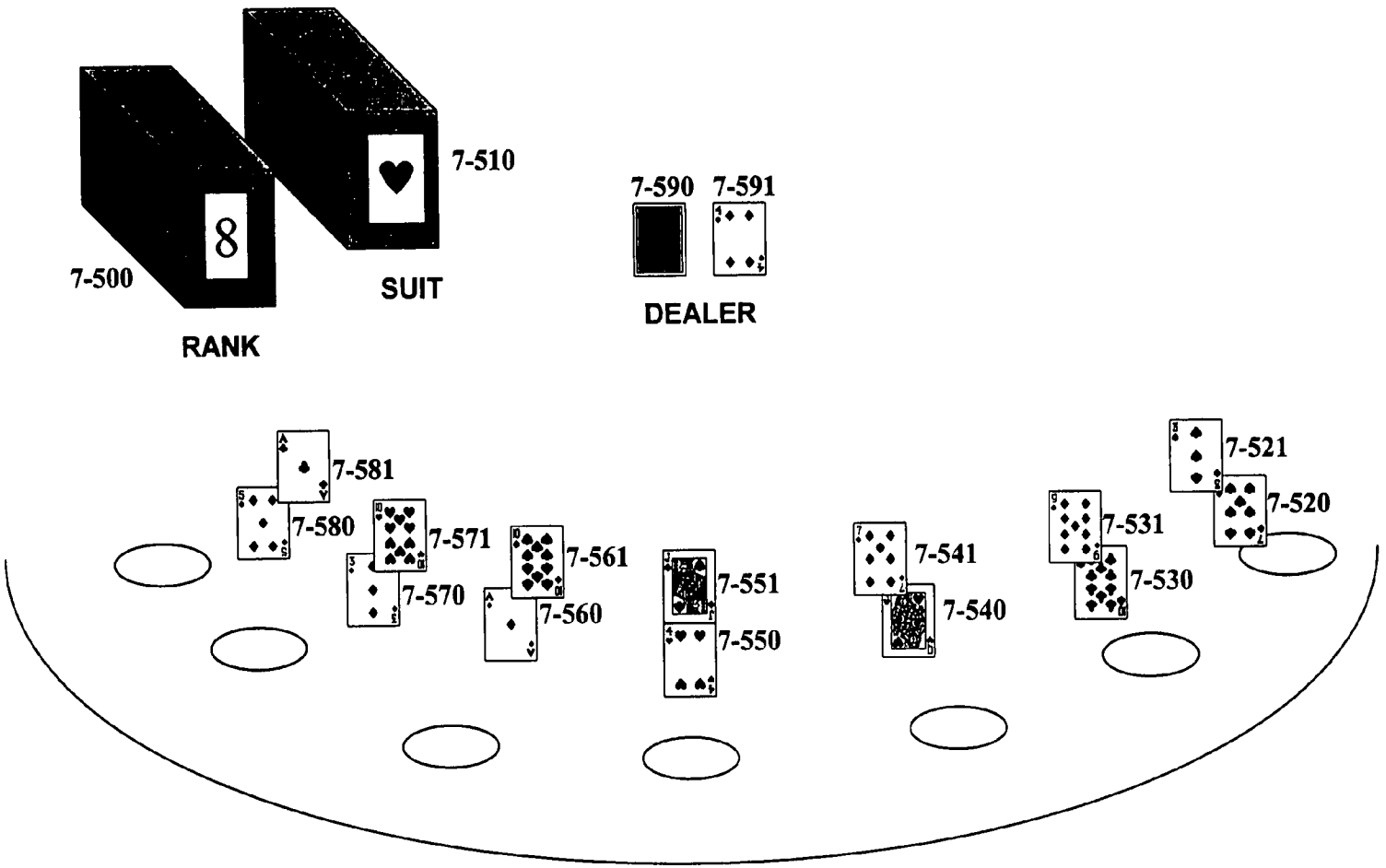
FIGS. 7 and 8 show a table version of the blackjack type game using this invention.
Figure 8:
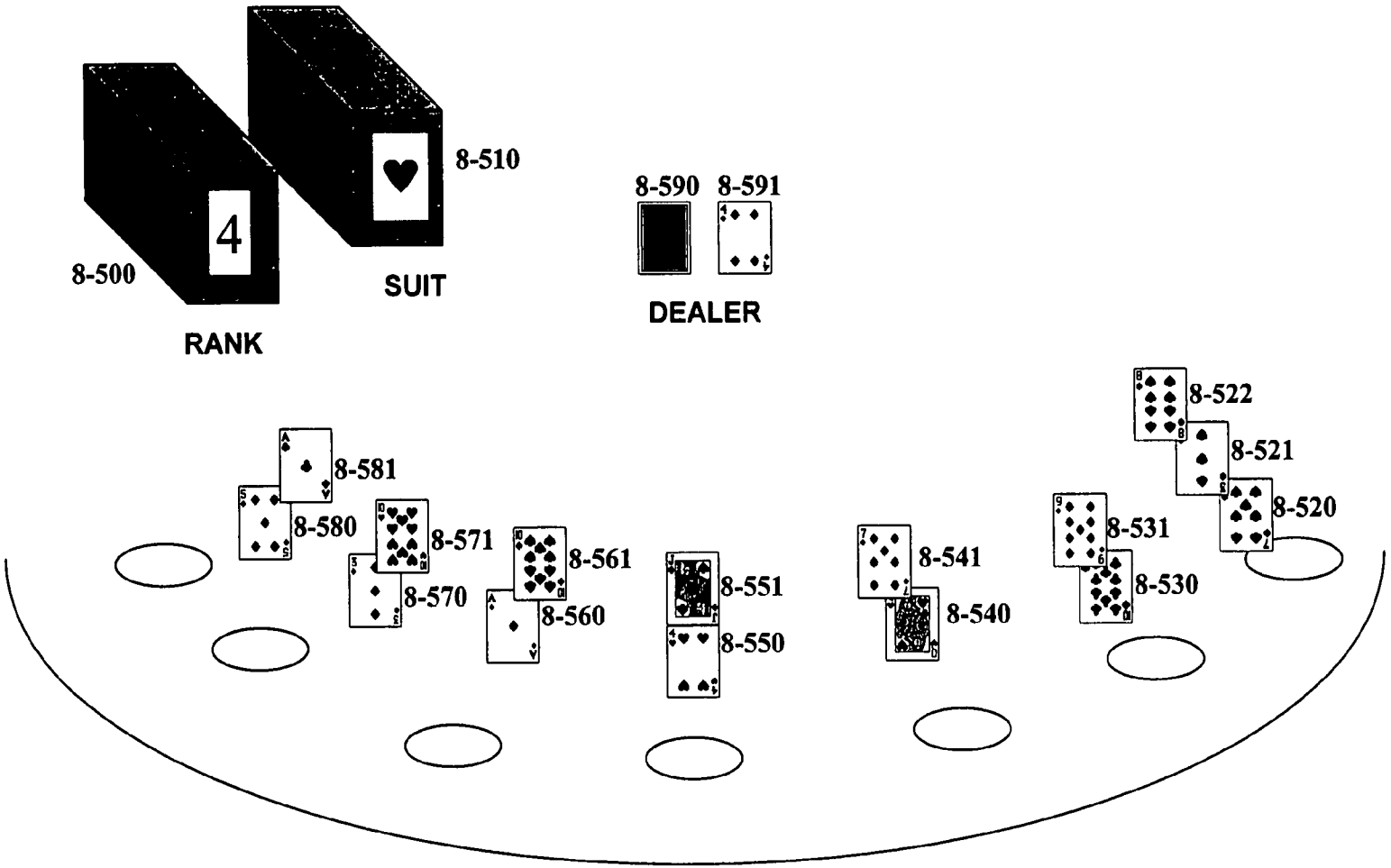

Additionally, these games could be played as table games. There are a number of ways to display the rank cards and suit cards for each game. For example, if they were played as table game, there could be two shoes that contained the cards as in FIG. 7. One shoe would have a means to display the next card's rank, as in element 7-500 showing an 8, while the other would display the next card's suit as in element 7-510 showing a heart. After a player selects either the suit or rank card, the dealer adds it to the player's hand. FIG. 8 shows the same game as FIG. 7 with the first player having received the 8 (element 7-500) as element 8-522 of his hand. A new rank card (4) now appears in the rank shoe as element 8-500.

A device for showing the rank employing translucent colored lights, one red and one blue on each shoe could be used. The cards would be colored such that one filter would pass through a card's suit while the other would pass through the card's rank and the other shoe could have a blue filter to permit either the rank or the suit to be visible.

Another way to display the suit and rank would by means of the card reader technology and display system described in U.S. Pat. No. 6,460,848 for each shoe, and the suits and ranks would be displayed on a video monitor for the player(s) and dealer to see. Yet another alternative would be with a single shoe and two separate devices for displaying the rank and suit of the cards. These devices could be attached directly to the shoe such that the cards were mechanically delivered to the card readers or displays. Alternatively, a table game could be played with cards appropriately coded and with a mechanism to display electronically cards dealt on a table. Using this arrangement, the player could be given an option of selecting either cards with a known rank or cards where the suit was known. One way to make this table game would be to have video screens in front of each player so he knows what cards are available to be drawn and what cards are in his hand. The game could also be made where each player's video screen was shielded from the other players so that only the player could see his own hand.

The devices could also be freestanding with the dealer placing cards in or under each device for the display or reader to be activated.

"Steal the Dealer's Card"

Another embodiment of the invention is a blackjack game where the player could select the dealer's up card and as use it as his own. For example, in FIG. 8 the player with the hand 8-540 and 8-541, which totaled 17, could take the dealer's 4 (8-591) and improve his hand to 21.

In a related embodiment, the player could be required to make an additional payment to obtain the dealer's card.

If the player took the dealer's card, the dealer would get a replacement card. In the version of the game where the rank of the next card is displayed, the dealer could choose to take either the visible rank card or take the suit card. The dealer's choice could be made immediately after his card was taken, or to improve his odds of winning the dealer could reveal his down card and then choose which card to take as a replacement card.

The Steal the Dealer's Card game could also be played with conventional cards that had non-descriptive backs. If conventional cards were used, the game can be played as a table game or as a video game.

Diamond Poker Game

Figure 9:
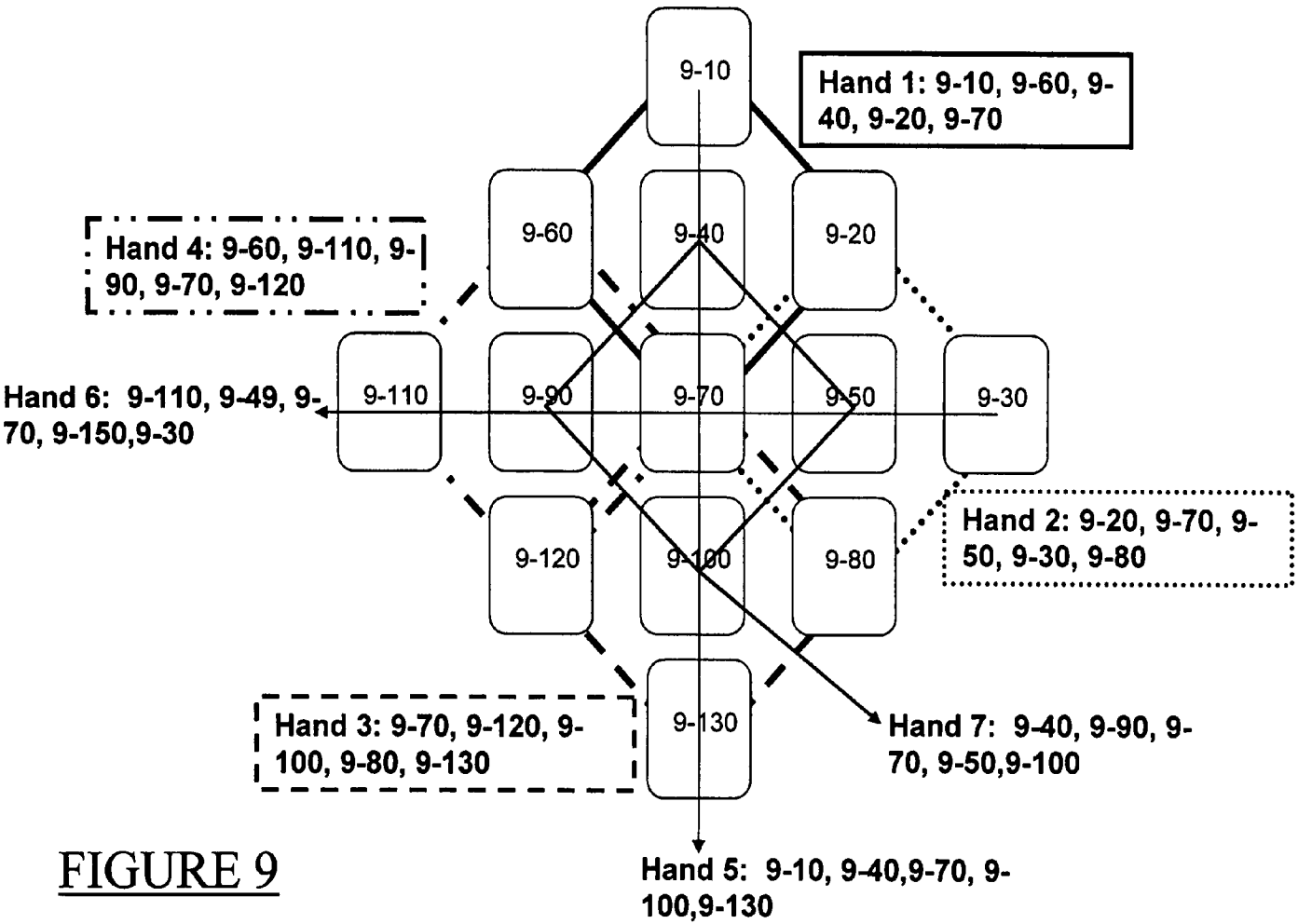
FIG. 9 shows a diamond-shaped poker game.

Another game the inventors have developed relates to poker. In this game the cards are dealt in a diamond configuration. See FIG. 9. That Figure shows seven five card poker hands can be dealt in the diamond pattern with 13 cards. The center card, 9-70, is common to all hands. One way to play the game is to deal four cards in each hand, excluding the center card. The player would then be given the opportunity to place an additional bet for each hand. Then he would be dealt the center card. The resulting hands would then be compared to a pay table. A bonus could be awarded, if for example four aces were dealt in the four outermost corners (9-10, 9-30, 9-130 and 9-110).

This game could be played with conventional cards or with the innovative cards described here that do not have non-descriptive backs.

This game can also be played with symbols instead of cards.

The invention claimed is:

1. A gaming apparatus for displaying cards from one or more decks of cards, where each deck of cards has four suits, each suit has thirteen ranks, every card of each deck has a unique combination of one of the four suits and one of the thirteen ranks, and where the cards are displayed in one of three states:

(a) a first state showing only the rank associated with the card, (b) a second state showing only the suit associated with the card, or (c) a third state showing both the rank associated with the card and the suit associated with the card, where the third state of every card always shows the same rank displayed in the first state (a) or the same suit displayed in the second state (b);

each card is in either the first state or second state when initially displayed in the card game; and the state of each card transforms from the first state or the second state to the third state in response to one or more actions by a player of a card game on the gaming apparatus.

2. The gaming apparatus of claim 1 for displaying cards from a deck of 52 cards.

3. The gaming apparatus of claim 1 for displaying cards from two or more decks of 52 cards.

4. The gaming apparatus of claim 1 for displaying further one or more additional cards wherein each additional card is a joker or wild card.

5. The gaming apparatus of claim 1 for displaying a maximum of 13 cards in any one suit.

6. A method to play a poker game where cards area dealt from a plurality of playing cards having four suits, where each suit has thirteen ranks, where each card has one of the four suits and one of the thirteen ranks, the method comprising:

(A). displaying each card in one of three states:

(i) a first state where only the suit associated with the card is displayed;

(ii) a second state where only the rank associated with the card is displayed; or (iii) a third state where both the suit from (A)(i) and rank from (A)(ii) are displayed the method further comprising:

(B). dealing cards to a player in a diamond pattern, each of the four sides of the diamond forming a five card poker hand with three interior cards and two corner cards wherein the dealt cards are initially displayed in the first or second state;

C. the player exchanging cards between hands;

D. after the exchanges, the display of the cards transforming into the third state;

E. comparing each hand to a paytable; and

F. rewarding the player according to the paytable.

7. The method to play a poker game of claim 6 further comprising the player placing a tangible wager on the outcome of the game.

8. The method to play a poker game of claim 6 further comprising the player paying for exchanging cards between hands.

9. The method to play a poker game of claim 6 wherein dealing the cards in a diamond pattern further comprises displaying conventional cards face-down as the corner cards; where the player exchanging cards between hands further comprises the player exchanging some or all of the interior cards; and further comprising displaying the corner cards in the third state after the exchanges.

10. The method to play a poker game of claim 6 wherein dealing the cards in a diamond pattern further comprises displaying one or more of the interior cards as conventional cards face-up when dealt.

11. A method for displaying cards from a deck of playing cards, the deck having four suits, each suit having thirteen ranks, each card of the deck is associated with one of the four suits and one of the thirteen ranks, and there is at least one card associated with each suit, the method comprising:

(A). displaying one or more cards to a user, where each displayed card is in either one or the other of two states:

(1) a first state in which only the rank associated with the card appears; or (2) a second state in which only the suit associated with the card appears;

(B). receiving from the user, a selection of one or more cards from the one displayed cards;

C. displaying the selected card, or cards, in a third state in response to the user's selection, where for the card in the third state both the rank and the suit of the selected card that appeared in either the first state A.(1) or the second state A.(2) appear.

12. The method of claim 11, wherein the deck of playing cards comprises 52 playing cards.

13. The method of claim 11, where the cards are displayed in a poker game.

14. The method of claim 11, where the cards are displayed in a blackjack game.

15. The gaming apparatus of claim 1 wherein two or more cards are dealt and the display of the two or more dealt cards shows only the rank associated with at least one of the two or more dealt cards.

* * * * *